US007958953B2

(12) United States Patent
Chafai

(10) Patent No.: US 7,958,953 B2
(45) Date of Patent: Jun. 14, 2011

(54) DRILLING TOOL

(75) Inventor: Ridha Chafai, Gloucestershire (GB)

(73) Assignee: National Oilwell Varco, L.P., Houston, TX (US)

( * ) Notice: Subject to any disclaimer, the term of this patent is extended or adjusted under 35 U.S.C. 154(b) by 0 days.

(21) Appl. No.: 12/574,039

(22) Filed: Oct. 6, 2009

(65) Prior Publication Data

US 2010/0089659 A1 Apr. 15, 2010

(30) Foreign Application Priority Data

Oct. 9, 2008 (GB) ..... 0818493.9

(51) Int. Cl.
*E21B 10/40* (2006.01)
*E21B 10/00* (2006.01)

(52) U.S. Cl. ..... 175/391; 175/398

(58) Field of Classification Search ..... 175/385, 175/391, 398
See application file for complete search history.

(56) References Cited

U.S. PATENT DOCUMENTS

| | | | | | |
|---|---|---|---|---|---|
| 3,757,878 | A | | 9/1973 | Wilder et al. | 175/329 |
| 4,944,817 | A | | 7/1990 | Bourell et al. | 156/62.2 |
| 5,031,483 | A | | 7/1991 | Weaver | 76/107.1 |
| 5,088,047 | A | | 2/1992 | Bynum | 364/474.24 |
| 5,204,055 | A | | 4/1993 | Sachs et al. | 419/2 |
| 5,433,280 | A | | 7/1995 | Smith | 175/336 |
| 5,495,899 | A | * | 3/1996 | Pastusek et al. | 175/57 |
| 5,544,550 | A | | 8/1996 | Smith | 76/108.2 |
| 5,678,644 | A | * | 10/1997 | Fielder | 175/391 |
| 5,839,329 | A | | 11/1998 | Smith et al. | 76/108.2 |
| 5,902,441 | A | | 5/1999 | Bredt et al. | 156/284 |
| 5,957,006 | A | | 9/1999 | Smith | 76/108.2 |
| 5,992,548 | A | * | 11/1999 | Silva et al. | 175/391 |
| 6,007,318 | A | | 12/1999 | Russell et al. | 425/130 |
| RE36,817 | E | * | 8/2000 | Pastusek et al. | 175/334 |
| 6,200,514 | B1 | | 3/2001 | Meister | 264/401 |
| 6,209,420 | B1 | | 4/2001 | Butcher et al. | 76/108.2 |
| 6,340,064 | B2 | * | 1/2002 | Fielder et al. | 175/385 |
| 6,353,771 | B1 | | 3/2002 | Southland | 700/197 |
| 6,354,362 | B1 | | 3/2002 | Smith et al. | 164/332 |
| 6,375,874 | B1 | | 4/2002 | Russell et al. | 264/28 |
| 6,386,302 | B1 | * | 5/2002 | Beaton | 175/406 |
| 6,416,850 | B1 | | 7/2002 | Bredt et al. | 428/297.4 |
| 6,454,030 | B1 | | 9/2002 | Findley et al. | 175/425 |
| 6,581,671 | B2 | | 6/2003 | Butcher et al. | 164/334 |
| 6,609,580 | B2 | * | 8/2003 | Beaton | 175/406 |
| 6,610,429 | B2 | | 8/2003 | Bredt et al. | 428/703 |
| 6,655,481 | B2 | | 12/2003 | Findley et al. | 175/425 |
| 6,659,207 | B2 | * | 12/2003 | Hoffmaster et al. | 175/391 |
| 6,913,098 | B2 | * | 7/2005 | Fielder et al. | 175/385 |

(Continued)

OTHER PUBLICATIONS

GB0917244.6 Search Report (Dec. 21, 2009).

*Primary Examiner* — Daniel P Stephenson
*Assistant Examiner* — Kipp C Wallace
(74) *Attorney, Agent, or Firm* — Conley Rose, P.C.

(57) ABSTRACT

A bi-center drilling tool comprises a main reamer region located eccentrically to an axis of rotation of the tool, and a leading cutting structure located ahead of the main reamer region, in the drilling direction. The leading cutting structure is located so as to apply a side loading to the drilling tool. The side loading is in direction to counter the loading which, in use, is due to the main reamer region being eccentric to the axis of rotation.

8 Claims, 2 Drawing Sheets

U.S. PATENT DOCUMENTS

| | | | | |
|---|---|---|---|---|
| 6,989,115 | B2 | 1/2006 | Russell et al. | 264/39 |
| 7,037,382 | B2 | 5/2006 | Davidson et al. | 134/21 |
| 7,087,109 | B2 | 8/2006 | Bredt et al. | 106/691 |
| 7,137,463 | B2 * | 11/2006 | Beaton | 175/406 |
| 7,562,725 | B1 | 7/2009 | Broussard et al. | 175/93 |
| 2002/0104688 | A1 | 8/2002 | Hoffmaster et al. | 175/385 |
| 2003/0173114 | A1 * | 9/2003 | Presley et al. | 175/57 |
| 2004/0099448 | A1 * | 5/2004 | Fielder et al. | 175/385 |
| 2007/0277651 | A1 | 12/2007 | Calnan et al. | 76/108.4 |
| 2008/0028891 | A1 | 2/2008 | Calnan et al. | 76/108.4 |
| 2009/0223721 | A1 * | 9/2009 | Dourfaye | 175/426 |
| 2010/0108396 | A1 * | 5/2010 | Chafai et al. | 175/385 |

* cited by examiner

DRILLING TOOL

CROSS REFERENCE TO RELATED APPLICATIONS

This application claims priority from GB Patent Application GB0818493.9, filed Oct. 9, 2008.

BACKGROUND OF THE INVENTION

1. Field of the Invention

This invention relates to a drilling tool suitable for use in the drilling of boreholes, for example for subsequent use in the extraction of oil and/or natural gas. In particular the invention relates to a drilling tool whereby borehole regions of increased director can be formed.

2. Description of the Related Art

When drilling or finishing boreholes, it is sometimes required to provide regions of increased diameter. Obviously, the tools used in the formation of the increased diameter regions of the borehole must be capable of being passed through any smaller diameter regions of the borehole above the position at which the larger diameter region is to be formed. This places considerable design constraints on the tools that can be used in such applications.

It is known to use drilling tools having a number of movable components, movable to vary the diameter of the borehole drilled thereby. However, the number of movable parts can result in such tools being relatively complex, susceptible to failure as a result of parts thereof becoming jammed, and also require associated control systems to be provided to control the operation thereof.

Another known type of tool suitable for use in such applications is a bi-center tool. Such a tool may include a pilot or mid-reamer region and a main reamer region located eccentrically to the mid-reamer region. In such an arrangement, when the tool is required to form a region of relatively large diameter, it is rotated about the axis of rotation of the mid-reamer region, while a weight on bit loading is applied. The mid-reamer region forms or finishes a bore region of relatively small diameter which is subsequently enlarged by the eccentric main reamer region, the mid-reamer region bearing against the wall of the bore and serving to guide the tool, reacting the side loadings applied due to the eccentric positioning of the main reamer region. Where smaller diameter regions are required, the tool is supported with the axis of rotation of the mid-reamer region located eccentric to the center of the borehole, the dimensions of the tool being such as to permit it is to be passed through smaller diameter regions of the borehole. Tools of this general type are described in, for example, U.S. Pat. No. 5,678,644 and US 2002/0104688.

The eccentric location of the main reamer region, as is necessary in a bi-center tool, results in the tool being out of balance, in use, in the manner outlined hereinbefore. The side loadings resulting form the tool being out-of-balance may result in, for example, the tool tending to tilt, and result in the tool being urged in directions other than that in which it is desired to extend the borehole. Also, the out-of-balance forces may result in the tool tending to rotate about an axis other than the intended axis of rotation of the mid-reamer region which can result in the part of the borehole being drilled by the main reamer region being of a different, for example smaller, diameter than desired. Further, the out-of-balance forces may result in certain parts of the tool being subject to excessive wear or result in damage thereto, in use. Obviously, these effects are disadvantageous and it is an object of the invention to provide a drilling tool in which the disadvantages set out hereinbefore are overcome or of reduced effect.

In the U.S. Pat. No. 5,678,644 arrangement, the drilling tool is designed in such a manner as to include penetration limiting means operable to limit the depth of penetration of at least some of the cutters provided on the tool. It is thought that limiting the depth of penetration in this way can serve to reduce tilting and whirling of the bit. However, limiting the depth of penetration in this manner only addresses issues arising from excessive penetration, and does not address instability arising from other factors. U.S. Pat. No. 5,678,644 further describes a design technique whereby the resultant cutting force of the pilot section of the bit and that of the reamer section of the bit can be substantially balanced in the sense that they are substantially oppositely directed and of substantially equal magnitude.

BRIEF SUMMARY OF THE INVENTION

According to the present invention there is provided a bi-center drilling tool comprising a main reamer region located eccentrically to an axis of rotation of the tool, and an out-of-balance leading cutting structure located ahead of the main reamer region, in the drilling direction, the leading cutting structure being located so as to apply a side loading to the drilling tool, the direction in which the side loading acts being such as to counter a side loading applied, in use, due to the main reamer region being eccentric to the axis of rotation.

The leading cutting structure preferably comprises at least one leading blade provided with cutters. Conveniently a single such leading blade is provided.

Preferably a mid-reamer region is located between the main reamer region and the leading cutting structure.

Preferably, the main reamer region is centered about an axis spaced from an axis of rotation of the mid-reamer region in a direct direction, the leading blade extending away from the axis of rotation of the mid-reamer region in a second, opposite direction to the first direction.

The leading blade has an outer surface which is preferably provided with a wear resistant layer, for example in the form of thermally stable diamond protection. The leading blade preferably includes a plurality of cutters which may be designed and/or orientated so as to enhance the magnitude of the side loading achievable thereby. Such an arrangement is advantageous in that it may permit balancing or compensation for the side loadings applied when larger, or more eccentric, main drilling regions are provided, thereby permitting larger diameter borehole regions to be drilled. It may thus permit balancing of large diameter tools which are usually difficult to balance. By providing drilling tools which are balanced or are of improved balance, the disadvantages set out hereinbefore are overcome or are of reduced effect. For example, the risk of undersized hole regions being formed is reduced, and the risk of undesired deviations in the borehole occurring is also reduced.

BRIEF DESCRIPTION OF THE DRAWINGS

The invention will further be described, by way of example, with reference to the accompanying drawings, in which.

DETAILED DESCRIPTION OF THE INVENTION

Figure 1:
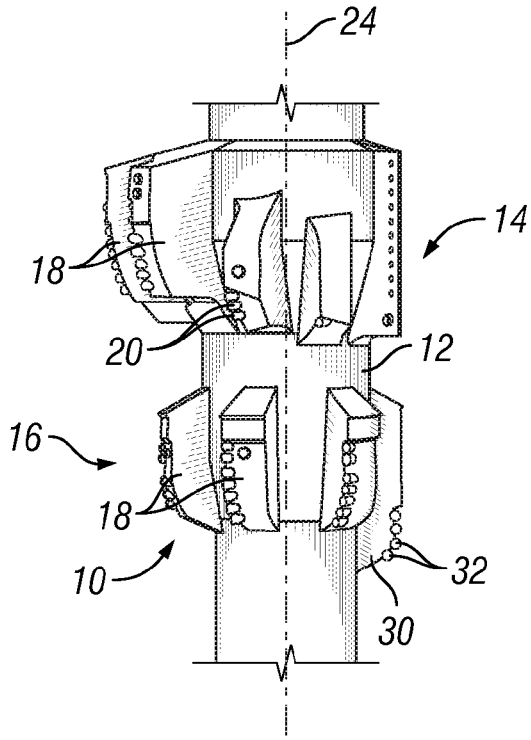
FIG. 1 is a diagrammatic side view of a drilling tool in accordance with one embodiment of the invention.

Referring to the accompanying drawings, a bi-center drilling tool 10 is illustrated. The tool 10 comprises a reamer intended to be mounted part-way along a drill string and operable to permit regions of a borehole to be finished and, where desire, enlarged. Although the illustrated tool is a reamer, it will be appreciated that the invention is also applicable to other types of drilling tool.

The drilling tool 10 comprises a tool body 12, for example of cast steel form. However, other materials for the tool body are possible. The tool body 12 is shaped to define a main reamer region 14 and a mid-reamer region 16. Each region 14, 16 includes a series of upstanding blades 18 on the bit body 12, the blades 18 each carrying a series of cutting elements 20 in the form of polycrystalline diamond compact cutters. One way in which the cutting elements 20 can be secured in position on the blades 18 is by brazing to sockets or other formations formed on the blades. However, a number of other fixing or mounting techniques may be used. Likewise, the invention also covers the use of other types of cutting element.

Figure 2:
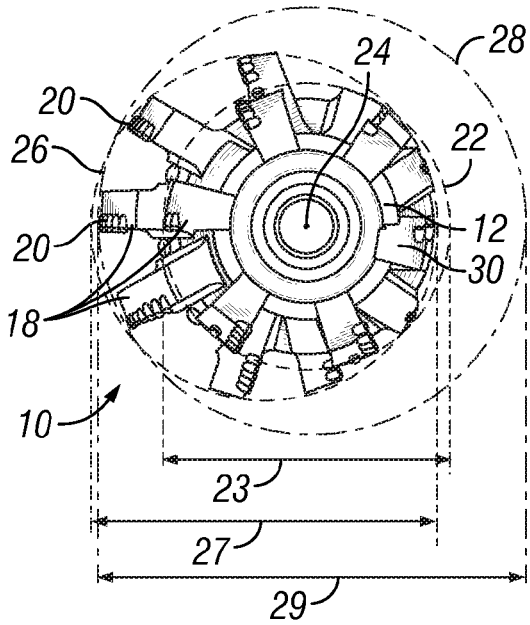
FIG. 2 is an end view of the tool illustrated in FIG. 1.
Figure 3A:
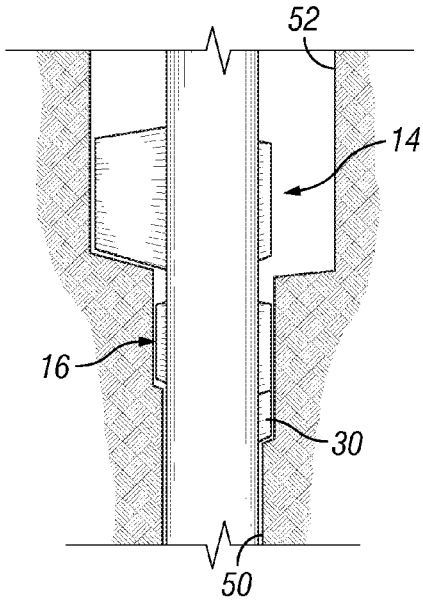
FIGS. 3*a* and 3*b* are diagrammatic representation of the tool of FIG. 1, in use.
Figure 3B:
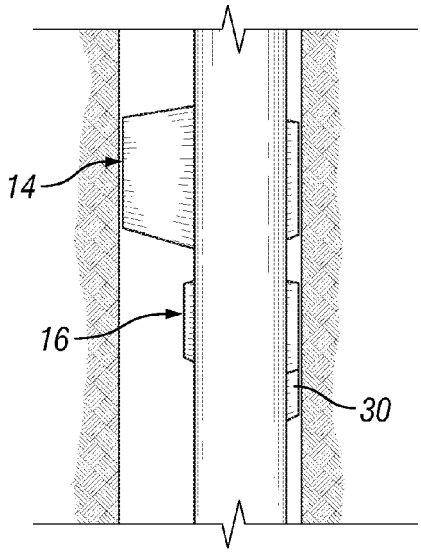

As can be seen from FIG. 2, most of the blades 18 of the mid-reamer region 16 extend substantially to a pilot gauge circle 22 of diameter 23 centered upon an axis of rotation 24 of the drilling tool 10. The blades 18 of the main reamer region 14 extend substantially to a pass through circle 26 of diameter 27 eccentric to the pilot circle 22. A part of the pilot gauge circle 22 projects outside of the pass through circle 26, and in this part of the tool the blades 18 of the mid-reamer region 16 extend radially outwardly only as far as the pass-through circle 26, not as far as the pilot gauge circle 22.

Where relatively large diameter regions of the borehole are required, the tool 10 is supported so as to be rotated about the axis of rotation 24 while an appropriate weight-on-bit loading is applied thereto. Such rotation results in the mid-reamer region 16 bearing against the borehole wall, scraping, abrading or otherwise removing formation material so as to drill or increase the diameter of a pilot hole 50 (see FIG. 3*a*). The rotation also results in rotation of the eccentric main reamer region 14, which sweeps a circle 28 of diameter 29, and the cutters 20 located on the blades 18 of the main reamer region 14 scrape, abrade or otherwise remove formation material, extending the diameter of the pilot hole 50 to form a borehole 52 of substantially the diameter 29.

During such operation of the drilling tool 10, it will be appreciated that the eccentric positioning of the main reamer region 14 results in the application of relatively large side loadings or other out-of-balance forces being applied. In order to counter these forces, in accordance with the invention, an additional leading cutting structure in the form of a leading blade 30 is provided on the tool 10, the leading blade 30 being provided ahead of the main reamer region 14 and, in the illustrated embodiment is located in a position ahead of the mid-reamer region 16 in the drilling direction. The leading blade 30 is located on the tool 10 in a position diametrically opposite that in which the main reamer region 14 is most eccentric to the axis 24 of rotation. The leading blade 30 extends, in this embodiment, to a radial position such that it lies substantially on the pass through circle 26, although some of the benefits of the invention may be achievable with the leading blade 30 extending to other radial positions.

The leading blade 30 is provided with cutting elements 32, for example in the form of polycrystalline diamond compact cutters, which are preferably orientated so as to achieve the application of relatively large side or out-of-balance loadings. This may be achieved by using large chamfered cutters with appropriate back rakes. Similarly, the shape of the leading blade 30 is preferably such that a relatively steep cutting profile is achieved as this, too, will enhance the magnitude of the balancing force that can be applied by the provision of the leading blade 30. The outer surface of the leading blade 30 is preferably protected from wear, for example by the application of thermally stable diamond protection (not shown) thereto. Alternatively, or additionally, a PDC or tungsten carbide inserts or components of other materials may be provided on the leading blade 30, for example in association with the cutters thereof (for example either behind or between the cutters), to share impact load, control drilling torque, enhance durability and/or create additional drilling forces.

The provision of the leading blade 30 results, in use, in the application of an initial or early out-of-balance, side loading to the drilling tool 10, acting in a direction countering that applied by the main reamer region 14 when the tool 10 is being used to increase the borehole diameter. As outlined hereinbefore, balancing of, or reducing the degree of net out-of-balance loadings acting on drilling tool 10 is advantageous in that the risk of undersized hole regions being drilled is reduced. Additionally, tilting of the drilling tool, and the formation of deviations in the borehole may be reduced. It may also permit balancing of relatively large eccentric reamers or other drilling tools, and allow extra blades to be provided thereon, if required.

Where relatively small diameter regions of the borehole are required, the tool can be passed through those regions of the borehole by locating the tool so that the axis 24 is eccentric to the axis of the said region of the borehole. In this manner, the tool can be passed through the borehole regions of diameter as small as the pass the pass through diameter 27 despite the tool being capable of drilling borehole regions that are considerably larger, i.e. of diameter 29.

Although in the arrangement illustrated and described hereinbefore only a single leading blade 30 is provided, arrangements may be possible in which two or more such blades are provided, the locations and designs of the leading blades being such that the net out-of-balance loadings applied to the drilling tool thereby acts in a direction substantially countering the direction in which the out-of-balance forces arising from the operation of the main drilling region act. Further, one or more bearing pads may also be provided at substantially the same axial position as the leading cutting structure, if desired.

A wide range of modifications and alterations may be made to the arrangement described hereinbefore without departing from the scope of the invention. So, whereas the present invention has been described in particular relation to the drawings attached hereto, it should be understood that other and further modifications apart from those shown or suggested herein, may be made within the scope and spirit of the present invention.

What is claimed is:

1. A bi-center drilling tool 10 for drilling a borehole comprising a diameter 29, the tool 10 further comprising a main reamer region located eccentrically to an axis of rotation 24 of the tool, and an out-of-balance leading blade 30 located ahead of the main reamer region, in the drilling direction, the leading blade 30 being located so as to apply a side loading to the drilling tool, the direction in which the leading blade 30 side loading acts being such as to counter a side loading applied, in use, due to the main reamer region being eccentric to the axis of rotation, wherein, a majority of first blades 18 of a mid-reamer region 16 extend substantially to a pilot gauge circle 22 of a first diameter 23 centered upon the axis of rotation 24 of the drilling tool 10, and second blades of the main reamer region 14 extend substantially to a pass through circle 26 of a second diameter 27 eccentric to the pilot circle 22, a part of the pilot gauge circle 22 projects outside of the pass through circle 26, and in this part of the tool, the blades 18 of the mid-reamer region 16 extend radially outwardly only as far as the pass-through circle 26, and not as far as the pilot gauge circle 22, such that in operation, the second blades 18 drill the full borehole diameter 29.

2. The bi-center drilling tool of claim 1, wherein the leading blade 30 comprises at least one leading blade provided with cutters.

3. The bi-center drilling tool of claim 2, wherein the leading blade 30 has cutting structure comprising a single leading blade.

4. The bi-center drilling tool of claim 1, wherein the mid-reamer region is located between the main reamer region and the leading cutting structure.

5. The bi-center drilling tool of claim 4, wherein the main reamer region is centered about an axis spaced from an axis of rotation of the mid-reamer region in a first direction, the leading cutting structure extending away from the axis of rotation of the mid-reamer region in a second, opposite direction to the first direction.

6. The bi-center drilling tool of claim 1, wherein the leading blade 30 cutting structure has an outer surface which is provided with a wear resistant layer.

7. The bi-center drilling tool of claim 1, wherein the leading blade 30 cutting structure includes a plurality of cutters which are designed and/or orientated so as to enhance the magnitude of the side loading achievable thereby.

8. The bi-center drilling tool of claim 6, wherein a cutting profile achieved by the leading blade 30 cutting structure is chosen so as to enhance the magnitude of the side loading achievable thereby.

* * * * *